US012492032B2

(12) United States Patent
Gianese et al.

(10) Patent No.: US 12,492,032 B2
(45) Date of Patent: Dec. 9, 2025

(54) METHOD AND MACHINE FOR INSPECTING THE PACKAGING OF PRODUCTS

(71) Applicant: G.D S.P.A., Bologna (IT)

(72) Inventors: Giampaolo Gianese, Bologna (IT); Luca Lanzarini, Bologna (IT)

(73) Assignee: G.D S.P.A., Bologna (IT)

( * ) Notice: Subject to any disclaimer, the term of this patent is extended or adjusted under 35 U.S.C. 154(b) by 0 days.

(21) Appl. No.: 18/601,407

(22) Filed: Mar. 11, 2024

(65) Prior Publication Data

US 2024/0317445 A1 Sep. 26, 2024

(30) Foreign Application Priority Data

Mar. 22, 2023 (IT) ..... 102023000005424

(51) Int. Cl.

| | |
|---|---|
| ***B65B 57/16*** | (2006.01) |
| ***B65B 9/04*** | (2006.01) |
| ***B65B 35/44*** | (2006.01) |
| ***B65B 57/12*** | (2006.01) |
| ***B65B 57/14*** | (2006.01) |
| ***B65B 65/00*** | (2006.01) |

(52) U.S. Cl.

CPC ..... *B65B 57/16* (2013.01); *B65B 9/045* (2013.01); *B65B 35/44* (2013.01); *B65B 57/12* (2013.01); *B65B 57/14* (2013.01); *B65B 65/003* (2013.01)

(58) Field of Classification Search

CPC ..... B65B 57/10–14; B65B 2210/02; B65B 9/045; B65B 11/52; B65B 35/54; B65B 5/068; B65B 35/36; B65B 35/38; B65B 35/44; B65B 5/08

USPC ..... 53/53–57

See application file for complete search history.

(56) References Cited

U.S. PATENT DOCUMENTS

| | | | | |
|---|---|---|---|---|
| 4,472,922 A * | 9/1984 | Romagnoli | B65B 57/10 53/53 |
| 5,033,251 A * | 7/1991 | Rodriguez | B07C 5/3404 53/494 |
| 5,040,353 A * | 8/1991 | Evans | B65B 57/10 53/53 |

(Continued)

FOREIGN PATENT DOCUMENTS

| | | | |
|---|---|---|---|
| DE | 4243206 A1 | 6/1994 | |
| DE | 10244804 B3 * | 1/2004 | B07C 5/122 |
| EP | 1445038 A2 * | 8/2004 | B07C 5/122 |

OTHER PUBLICATIONS

Italian Search Report dated Oct. 25, 2023 from counterpart Italian App No. IT202300005424.

*Primary Examiner* — Joshua G Kotis

(74) *Attorney, Agent, or Firm* — SHUTTLEWORTH & INGERSOLL, PLC; Timothy J. Klima

(57) ABSTRACT

A method for inspecting the packaging of products, in particular in blister packs, including a step of feeding a succession of trays along a main feed line, in which each tray includes a plurality of seats, each intended to accommodate a respective product. The method includes a step of detecting the presence of one or more empty seats in each tray in transit. Then, according to the result of detection, the method includes either a step of feeding the tray and filling the empty tray seats by taking one or more products arranged in an auxiliary replenishing line, or a step of transferring all products in the tray from the main feeding line to the auxiliary replenishing line.

18 Claims, 2 Drawing Sheets

(56) References Cited

Figure 1:
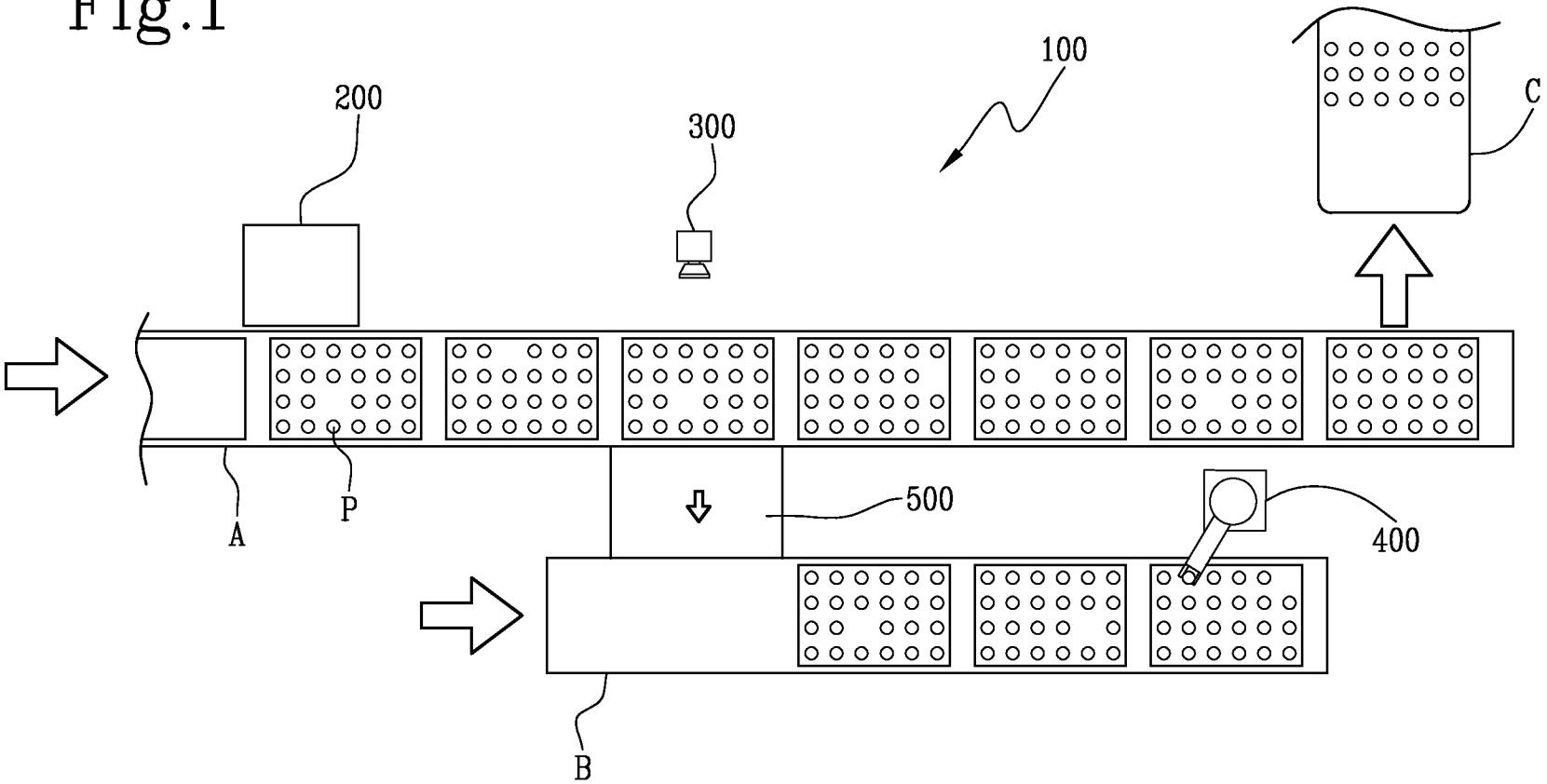

U.S. PATENT DOCUMENTS 5,442,892 A * 8/1995 Burns, III ..... B65B 69/00 53/53
5,553,442 A * 9/1996 Fadaie ..... B65B 35/38 53/238
5,568,715 A * 10/1996 Ebel ..... B65B 25/008 53/494
5,578,331 A * 11/1996 Martin ..... B29D 11/0024 264/2.6
5,607,642 A * 3/1997 Lepper ..... B65B 57/10 264/2.6
5,799,468 A * 9/1998 Eck ..... G06V 20/66 53/493
5,802,804 A * 9/1998 Esposti ..... B65B 35/26 53/505
5,829,222 A * 11/1998 Schlagel ..... B65B 57/00 198/689.1
6,122,895 A * 9/2000 Schubert ..... B25J 9/026 53/251
8,015,778 B2 * 9/2011 Tischhauser ..... B65B 57/20 414/270
11,542,107 B2 1/2023 Riekenbrauck
2010/0242415 A1 * 9/2010 Ehrat ..... B65B 5/105 53/251
2010/0303738 A1 * 12/2010 Ream ..... A21D 13/47 426/87
2012/0165972 A1 * 6/2012 Wappling ..... B25J 9/1687 700/213
2013/0319818 A1 * 12/2013 Worz ..... B65G 47/905 198/462.3
2015/0134110 A1 * 5/2015 Koyanagi ..... B65G 47/46 700/248
2016/0107782 A1 * 4/2016 Hutter ..... B65B 43/48 53/467
2017/0057682 A1 * 3/2017 Chudy ..... A61J 1/035
2019/0369600 A1 * 12/2019 Lager ..... B25J 9/0093
2021/0354866 A1 * 11/2021 Hahn ..... B65G 47/256
2021/0354933 A1 * 11/2021 Riekenbrauck ..... B65B 59/005
2022/0017249 A1 * 1/2022 Morikubo ..... B65G 47/918
2022/0280980 A1 * 9/2022 Lanzarini ..... B65G 47/907
2022/0315256 A1 * 10/2022 Storhas ..... B65B 43/46
2022/0396382 A1 * 12/2022 Bolognesi ..... B65B 57/14

* cited by examiner

METHOD AND MACHINE FOR INSPECTING THE PACKAGING OF PRODUCTS

This application claims priority to Italian Patent Application 102023000005424 filed Mar. 22, 2023, the entirety of which is incorporated by reference herein.

The present invention relates to a method and machine for inspecting the packaging of products, in particular in blister packs.

To date, to package products in blister packs, it is known to prepare a series of trays each provided with a plurality of seats each configured to accommodate a respective product.

The trays are filled with products and are conveyed along a conveyor, e.g., a belt, so that they are taken toward a packaging station, in which the products of a tray are wrapped together to form respective blister packs.

During the conveying of the tray, it is known to pass the trays through an inspection station, in which inspection means detect the absence of one or more products in the tray.

If at least one product is absent from the tray, i.e., the tray has at least one empty seat, the entire tray is removed from the conveyor to avoid obtaining a nonconforming blister in number and/or product placement. This results in a large amount of product rejection because, as mentioned, the entire tray of products is rejected from the conveyor if there is even one empty seat.

A tray may also contain products to form multiple blister packs. In this case, if one or more products are found to be missing, the blisters are still formed and the blister having the missing products is rejected.

To resolve this problem, it is also known to provide a filling station designed to fill the seats detected as empty in the inspection station downstream of the inspection station. The filling station is usually provided with a respective product holding hopper, separately fed by an operator.

Although this solution avoids rejecting trays and wasting products, it is particularly time-consuming and costly. Indeed, the hopper must be kept sufficiently filled and any lack would imply in the need to reject the products packaged from the incomplete tray.

Furthermore, the aforesaid solution does not allow for individual product traceability, which is lost because the products are fed from a hopper.

Thus, it is the technical task of the present invention to provide a method for inspecting the packaging of products and a machine for inspecting the packaging of products which can overcome the drawbacks arising by the prior art.

It is a further object of the present invention to provide a method and machine for inspecting the packaging of products which achieve high efficiency, in particular in terms of rejected products.

It is a further object of the present invention also to provide a method and machine for inspecting the packaging of products which do not require supervision and control by an operator.

The specific technical task and the specified objects are substantially achieved by a method and a machine for inspecting the packaging of products comprising the technical features presented in claims 1 and 13 and one or more of the appended claims.

In particular, the specific technical task and the specified objects are achieved by a method for inspecting the packaging of products, in particular in blister packs, comprising a step of feeding a succession of trays along a main feed line, wherein each tray comprises a plurality of seats, each intended to accommodate a respective product. The method further comprises a step of filling each tray seat with a respective product in a filling station located along the main feed line.

After the step of filling, the method comprises a step of detecting, in an inspection station arranged along the main feed line downstream of the filling station, the presence of one or more empty seats on each tray in transit in the inspection station.

Then, according to the main inventive concept, the method comprises one of the following steps, operated selectively as a function of the result of the detection:

- feeding the tray, together with the products accommodated thereon, along the main feed line towards a completing station, arranged along the main feed line downstream of the inspection station, and, in the completing station, filling the empty seats on the tray by picking up one or more products arranged on an auxiliary replenishing line, and sending the products of each tray to a packaging line; or
- transferring all the products of the tray from the main feed line to the auxiliary replenishing line.

In other words, according to the invention, the completing station is fed (preferably exclusively) with the products taken from some of the (preferably incomplete) trays in transit along the main feed line.

With this method, it is possible to allocate the products from some of the incomplete trays to the feeding of the completing station in a controlled manner. On one hand, this allows the automatic feeding of the completing station, which does not require intervention by an operator, and on the other hand it does not create rejects because the entire contents of the incomplete tray do not reach the packaging.

Preferably, the step of transferring products from the main feed line to the auxiliary replenishing line is operated at a transfer station arranged upstream of the completing station. In this situation, the method further comprises a step of feeding the products, taken at the transfer station, along the auxiliary replenishing line from the transfer station to the completing station. Doing so, if there are empty seats to be filled in the completing station, one or more products being fed along the auxiliary replenishing line can be picked up and placed in the seats to complete the tray. Afterward, the completed tray is sent to the packaging line.

The specified technical task and objects are also achieved by a machine for packaging the products, in particular in blister packs.

The machine comprises a main feed line configured to feed a succession of trays. Each tray comprises a plurality of seats each accommodating a product.

The machine further comprises a filling station located along the main feed line and configured for filling each tray seat with a respective product.

The machine then comprises an inspection station located along the main feed line downstream of the filling station and configured for detecting the presence of one or more empty seats on each tray in transit in the inspection station itself.

The machine further comprises a completing station, arranged along the main feed line downstream of the inspection station and configured for filling the empty seats on the tray in transit in the completing station by picking up one or more products in transit along an auxiliary replenishing line, and for sending the products of each tray to a packaging line.

The machine further comprises a transfer station, arranged upstream of the completing station and configured for transferring all the products on the tray in transit in the transfer station from the main feed line towards an auxiliary replenishing line.

The machine further comprises a management unit configured, based on the result of the detection, to alternately send a feed line command to bring the tray to the completing station, or a transfer command. The transfer control is sent to the transfer station for transferring all the products of the tray from the main feed line towards the auxiliary replenishing line.

Further features and advantages of the present invention will be more apparent in the following indicative and consequently non-limiting description of a preferred, but not exclusive embodiment of a method and a machine for inspecting the packaging of products.

Figure 2:
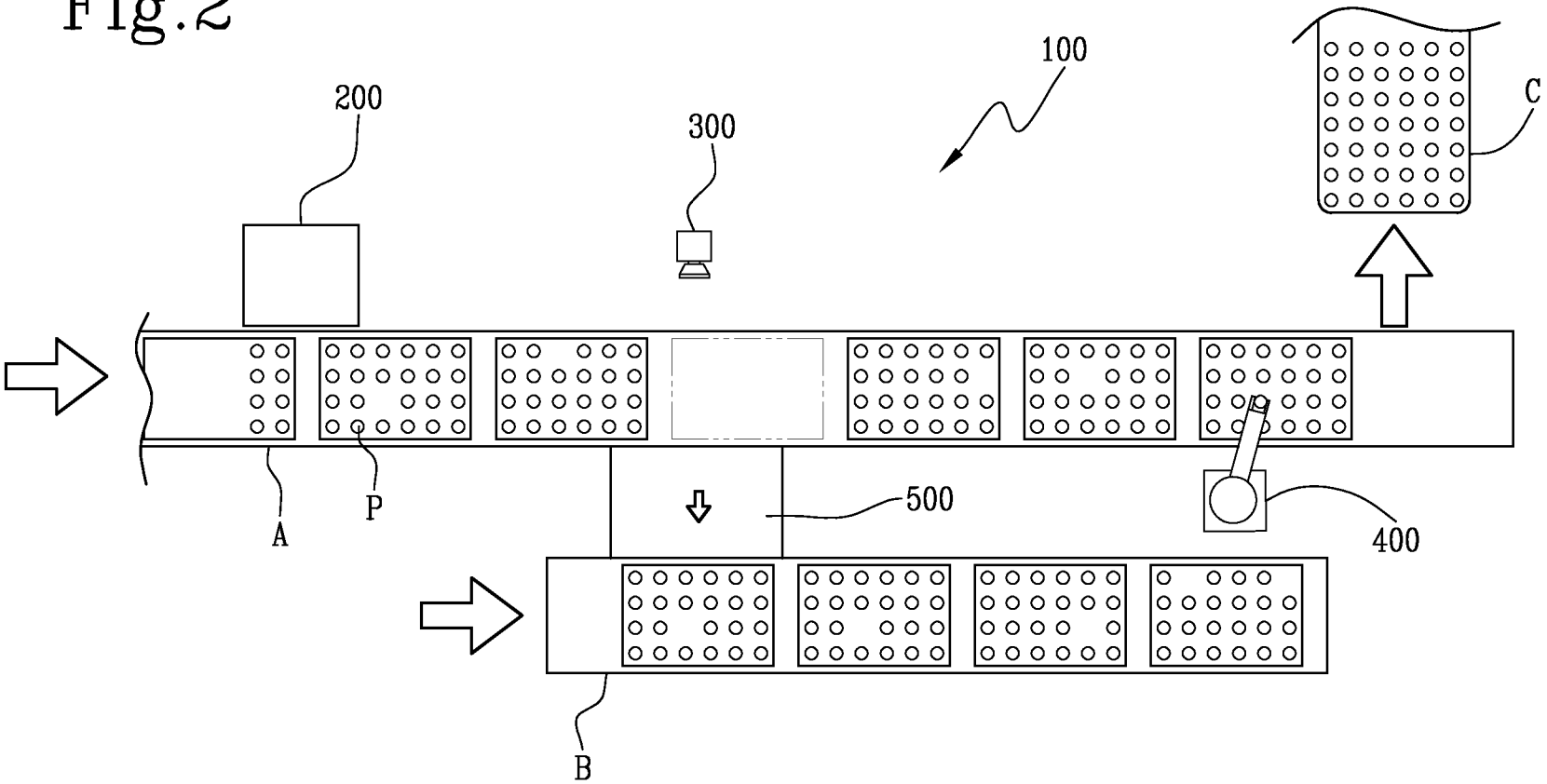

This description will be provided below with reference to the accompanying drawings, provided for illustrative, therefore non-limiting purposes, in which FIGS. 1 and 2 show a diagrammatic view of the machine according to the invention, illustrating different steps of the method covered by the present invention.

With reference to the accompanying figures, reference numeral 100 indicates a machine for inspecting the packaging of products, in particular in blister packs.

By way of non-limiting example, these products may be products of the tobacco industry or may be products of another nature suitable for packaging in blister (candy, drugs, capsules, etc.).

The machine 100 comprises a main feed line "A" configured to feed a succession of trays (the trays are diagrammatically represented by rectangles in the accompanying figures).

Each tray comprises a plurality of seats each accommodating a product "P".

In the preferred embodiment, the main feed line "A" is made by means of a linear conveyor. The linear conveyor could be, by way of a non-limiting example, a belt conveyor, belt or chain conveyor, with independent equipment, or others.

The machine 100 further comprises a filling station 200 arranged along the main feed line "A" and configured for filling each tray seat with a respective product "P".

The filling station is of a known type and will not be described in detail.

The machine 100 further comprises an inspection station 300 located along the main feed line "A" downstream of the filling station 200 and configured for detecting the presence of one or more empty seats on each tray in transit in the inspection station 300 itself.

In other words, the inspection station 300 is configured to detect whether the trays progressively passing through it have been correctly filled by the filling station 200 or whether one or more products "P" have been omitted, leaving some seats empty.

The machine 100 further comprises a completing station 400, arranged along the main feed line "A" downstream of the inspection station 300 and configured for filling the empty seats on the tray in transit in the completing station 400 by picking up one or more products "P" in transit along an auxiliary replenishing line "B".

According to a possible embodiment, the completing station 400 comprises a robotic arm configured to pick up and transfer individual products "P" from the auxiliary replenishing line "B" to the main feed line "A". In such a situation, the robotic arm can pick up the products "P" one by one, from the auxiliary replenishing line "B" and position them in the empty seats whatever their distribution within the tray.

Therefore, in use, in completing station 400, the empty tray seats in transit through completing station 400 itself are filled by taking one or more products "P" in transit along an auxiliary replenishing line "B".

In the preferred embodiment, the auxiliary replenishing line "B" is a linear conveyor. The linear conveyor could be, for example, a belt or chain conveyor.

In the preferred embodiment, the auxiliary replenishing line "B" and the main feed line "A" extend in a side-by-side and preferably parallel configuration.

In other words, the auxiliary replenishing line "B" and the main feed line "A" are parallel to each other so that trays and/or products "P" placed on them are fed along parallel directions.

According to an aspect of the present invention, after the completion of the missing products "P", the products "P" from each tray are sent to at least one packaging line "C", i.e., to a line along which the products "P" from a tray are packaged to make a blister pack.

The machine 100 further comprises a transfer station 500 arranged upstream of the completing station 400 and configured to transfer all the products "P" from the tray passing through it. The transfer is made from the main feed line "A" to the auxiliary replenishing line "B" as indicated by the arrow in FIG. 1.

In a preferred embodiment, the transfer station 500 comprises a linear or Cartesian transfer station, in particular configured to pick up the entire tray or simultaneously all products "P" in the tray.

Alternatively, the transfer could have any kinematic mechanism.

In the embodiment shown, the transfer station 500 is configured to take the entire tray from the main feed line "A" and arrange the picked tray on the auxiliary replenishing line "B".

Alternatively, the transfer station 500 is configured to simultaneously pick up all products "P" from the tray in transit in the completing station 400 and arrange them on auxiliary replenishing line "B".

Alternatively, the transfer station 500 is configured to pick groups of products "P" from the tray in transit in completing station 400 and arrange them on the auxiliary replenishing line "B" until the tray is completely emptied.

The machine 100 further comprises a management unit (not shown) configured to determine, based on the result of the detection made at the inspection station 300, whether the detected tray must be made to proceed along the main feed line "A" to the completing station 400 or whether the detected tray is to be transferred to auxiliary replenishing line "B".

According to an aspect of the invention, the selection between feeding the tray in transit in the inspection station 300 along the main feed line "A" to the completing station 400 and transferring all the products "P" of the tray from the main feed line "A" to the auxiliary replenishing line "B" is also made as a function of the total number of products "P" in transit on the auxiliary replenishing line "B".

In other words, based on the result of the detection, the management unit determines whether the detected tray must be made to proceed along the main feed line "A" to the completing station 400 or whether the detected tray is to be transferred to the auxiliary replenishing line "B".

In the first situation, any empty tray seats are filled and the completed tray is sent to the packaging line "C".

In the second situation, the management unit sends a transfer command to transfer station 500 to transfer all the products "P" in the tray (or the tray together with the products "P" contained therein) from the main feed line "A" to the auxiliary replenishing line "B". The transfer station 500 thus transfers to the transfer station of all the products "P" of the tray from the main feed "A" towards the auxiliary replenishing line "B".

According to a possible embodiment, the inspection station 300 and transfer station 500 are two separate stations.

Alternatively, the inspection station 300 and the transfer station 500 define a single station provided with inspection means capable of detecting the presence of empty seats and transfer means capable of transferring, when required, the products "P" and/or the tray in which they are accommodated from the main feed line "A" to the auxiliary replenishing line "B".

Preferably, the products maintain the same arrangement on the auxiliary replenishing line "B" as they had on the main feed line "A". In this case, the management unit knows and/or detects at all times the arrangement of products on the auxiliary replenishing line "B" thus identifying the products suitable to be picked up at the completing station 400.

In particular, the robotic arm of the completing station 400 can pick up the products "P" one by one from the auxiliary replenishing line "B" and position them in the empty seats of the trays arranged on the main feed line "A" whatever the product distribution on the auxiliary replenishing line "B".

Alternatively, the products taken from the transfer station 500 are collected in a hopper forming part of the completing station 400 and fed from there, individually, to the incomplete trays for completion (in which case the robotic arm may not be present).

The method for inspecting the packaging of products covered by the present invention will now be described in detail.

This method can be carried out, for example, by a machine in accordance with the above.

The method comprises a step of feeding a succession of trays along the main feed line "A" and a step of filling, in the filling station 200, arranged along the main feed line "A", each tray seat with a respective product "P".

The method further comprises a step of detecting, in the inspection station 300 located along the main feed line "A" downstream of the filling station 200, detecting the presence of one or more empty seats on each tray in transit in the inspection station 300 itself.

In other words, the inspection station 300 is configured to check whether the tray passing through it has missing products "P" (i.e. empty seats) or is completely full (i.e. no empty seats).

By way of non-limiting illustration, the detection can be by optical (cameras, photocells) and/or radiation type (ultrasound, microwave) means of detection.

As a function of the result of the step of detecting, the method selectively comprises at least two steps.

The first of said two steps consists of feeding the tray, together with the products "P" contained in it, along the main feed line "A" to the completing station 400. In this situation, the empty tray seats are filled in the completing station 400 by picking up, e.g., by means of a robotic arm, one or more products "P" arranged in the auxiliary replenishing line "B". Once filled, the products "P" from each tray are sent to the packaging line "C".

The second of said steps, instead, consists of transferring all products "P" in the tray from the main feed line "A" to the auxiliary replenishing line "B". In such a situation, following the result of the detecting phase, the products "P" from the tray subject to detection are transferred to the auxiliary replenishing line "B".

The tray can be transferred from the main feed line "A" to the auxiliary replenishing line "B" either if the inspected tray in the inspection station 300 has empty seats (preferred solution) or if the inspected tray in the inspection station 300 has no empty seats, i.e., it is full.

In other words, whether a tray has empty seats or all full seats, it can be transferred to the auxiliary replenishing line "B", as it will be more apparent hereafter.

According to a possible embodiment not shown, the step of transferring is achieved by leaving the tray on the main feed line "A". In this situation, the products "P" are taken simultaneously from the tray in transit on the main feed line "A" and are placed directly on the auxiliary replenishing line "B" or in one or more recirculating trays on the auxiliary replenishing line "B".

Alternatively, as shown in the accompanying figures, the step of transferring is accomplished by transferring the tray (and the products "P" in it) from the main feed line "A" to the auxiliary replenishing line "B".

According with the illustrated embodiment, the step of transferring products from the main feed line "A" to the auxiliary replenishing line "B" is operated by the transfer station 500 arranged upstream of the completing station 400.

The method further comprises a step of feeding the products "P", taken from the transfer station 500, along the auxiliary replenishing line "B" from the transfer station 500 to the completing station 400.

Indeed, in use, once the products "P", along with the tray in which they are accommodated or separately therefrom, have been transferred from the main feed line "A" to the auxiliary replenishing line "B," the latter feeds the products "P" to the completing station 400 so that on the auxiliary replenishing line "B" there are products "P" available to be able to carry out the step of filling the empty seats of the tray in transit through the completing station 400.

In other words, the products "P" placed on the auxiliary replenishing line "B" are progressively fed to the completing station 400 so that when there is a need to fill empty seats of a tray placed in the completing station 400, it is possible to take one or more products "P" from the auxiliary replenishing line "B" and place the products "P" in the empty seats of the tray in transit through the completing station 400.

According to a preferred embodiment, the step of feeding the products "P" along the auxiliary replenishing line "B" from the transfer station 500 to the completing station 400 is carried out at a different speed with respect to the speed of the main feed line "A".

Preferably, the products "P" are fed along the auxiliary replenishing line "B" at a speed lower than the speed of the main feed line "A".

According to an aspect of the present invention, the feed speed of the products "P" along the auxiliary replenishing line "B" is intermittent and/or variable in a controlled manner.

So that it always possible, in the completing station 400, to take the products "P" from the auxiliary replenishing line "B" and fill the empty seats of the tray in transit in the completing station 400 itself, the method comprises a step of inspecting or monitoring the total number of the products "P" in transit in the auxiliary replenishing line "B".

In this situation, the selection between the step of feeding the tray passing through the inspection station 300 along the main feed line "A" to the completing station 400 and the step of transferring all the products "P" of the tray from the main feed line "A" to the auxiliary replenishing line "B" is also made also as a function of the total number of products "P".

In particular, the selection is made by taking into consideration both the number of empty seats detected at inspection station 300 and the total number of products "P" in transit along the auxiliary replenishing line "B".

Preferably, the selection is also made taking into consideration other parameters, such as the speed of the main feed line "A", the speed of the auxiliary replenishing line "B", the arrangement of products "P" on the auxiliary replenishing line "B" and the like.

In other words, the fulfillment of the step of transferring all the products "P" of the tray in transit in inspection station 300 from the main feed line "A" to the auxiliary replenishing line "B" rather than the step of feeding the tray to the completing station 400 is operated based on several factors including the number of empty seats detected in the inspection station 300 and the total number of products "P" in transit along the auxiliary replenishing line "B".

According to the preferred embodiment, the step of inspecting or monitoring the total number of products "P" in transit in the auxiliary replenishing line "B" is carried out at each step of detecting the presence of one or more empty seats on a tray. In this situation, for example, if the total number of products "P" in transit on the auxiliary replenishing line "B" is less than a predetermined threshold number, a tray is picked up by transfer station 500 from the main feed line "A" and placed on the auxiliary replenishing line "B" so that the products "P" contained therein are transported to the completing station 400 and are available to fill the empty seats of the tray in transit the completing station 400 itself.

Advantageously, the present invention achieves its intended purposes by eliminating the drawbacks that emerged from the prior art.

In particular, the presence of the auxiliary replenishing line "B" ensures the constant presence of products "P" ready to be picked up to fill the empty seats of the trays in transit through the completing station 400, allowing costs and time associated with checking and filling trays to be lowered. Indeed, this action is automatic and constantly controlled according to process parameters, enabling high reliability.

The method of the present invention also decreases (or eliminates) waste products because all trays conveyed to the packaging line "C" are complete trays.

The invention claimed is:

1. A method for inspecting packaging of products in blister packs, comprising the following steps:

feeding a succession of trays along a main feed line, each tray comprising a plurality of seats, each of the seats configured for accommodating a respective product;

in a filling station located along the main feed line, filling each of the seats with a respective product;

in an inspection station located along the main feed line downstream of the filling station, detecting a presence of one or more empty seats on each tray in transit in the inspection station;

with a management unit and based on the result of the step of detecting:

sending a feed command to the main feed line to carry the tray to a completing station and, in the completing station, filling the empty seats on the tray by picking up one or more products from an auxiliary, replenishing line, and sending the products of each tray to a packaging line; or sending a transfer command to a transfer station, and transferring, by the transfer station, all the products of the tray from the main feed line towards the auxiliary, replenishing line; and wherein the management unit is configured to selectively send the feed command and the transfer command based on the result of the step of detecting.

2. The method according to claim 1, wherein the transfer station is located upstream of the completing line, and wherein the method also comprises a step of feeding the products picked up at the transfer station, along the auxiliary, replenishing line from the transfer station to the completing station.

3. The method according to claim 2, wherein the step of feeding the products along the auxiliary, replenishing line from the transfer station to the completing station is carried out at a different speed from a speed of the main feed line.

4. The method according to claim 3, wherein the step of feeding the products along the auxiliary, replenishing line from the transfer station to the completing station is lower than the speed of the main feed line.

5. The method according to claim 1, wherein a feed speed of the products along the auxiliary, replenishing line is intermittent and/or variable in a controlled manner.

6. The method according to claim 1, wherein the main feed line and the auxiliary replenishing line are embodied by respective linear conveyors.

7. The method according to claim 6, wherein the respective linear conveyors are belt, cleated, or chain conveyors.

8. The method according to claim 1, wherein the main feed line and the auxiliary replenishing line extend in a juxtaposed configuration.

9. The method according to claim 1, wherein the step of transferring all the products of the tray from the main feed line to the auxiliary, replenishing line is carried out while leaving the tray on the main feed line.

10. The method according to claim 1, wherein the step of transferring all the products of the tray from the main feed line to the auxiliary, replenishing line is carried out by transferring the tray from the main feed line to the auxiliary, replenishing line.

11. The method according to claim 1, and further comprising a step of checking or monitoring a total number of products in transit in the auxiliary, replenishing line; and wherein selecting between feeding the tray along the main feed line towards the completing station or transferring all the products of the tray from the main feed line to the auxiliary, replenishing line is done as a function of the total number of products.

12. The method according to claim 11, wherein the step of checking or monitoring the total number of products in transit in the auxiliary, replenishing line is carried out at each step of detecting the presence of one or more empty seats on a tray.

13. The method according to claim 1, wherein the step of transferring all the products of the tray from the main feed line to the auxiliary, replenishing line is carried out by a linear or Cartesian transfer unit.

14. The method according to claim 13, wherein the linear or Cartesian transfer unit is configured to pick up the whole tray or all the products on the tray simultaneously.

15. The method according to claim 1, wherein the step of filling the empty seats on the tray in the completing station by picking up one or more products from the auxiliary, replenishing line is carried out by a robotized arm.

16. The method according to claim 15, wherein the robotized arm is configured to pick up and transfer single products.

17. The method according to claim 1, wherein the main feed line and the auxiliary replenishing line extend in a parallel configuration.

18. A machine for packaging products in blister packs, comprising:

a main feed line, configured for feeding a succession of trays, each tray comprising a plurality of seats, each of which accommodates a product;

an auxiliary, replenishing line, configured to receive products transferred from the main feed line;

a filling station located along the main feed line and configured for filling each of the seats with a respective product;

an inspection station located along the main feed line downstream of the filling station, and configured for detecting a presence of one or more empty seats on each tray in transit in the inspection station;

a completing station, located along the main feed line downstream of the inspection station and configured for filling the empty seats on the tray in transit in the completing station by picking up one or more products in transit along the auxiliary, replenishing line, and for sending the products of each tray to a packaging line;

a transfer station, located upstream of the completing station and configured for transferring all the products on the tray in transit in the transfer station from the main feed line towards the auxiliary, replenishing line;

a management unit configured for sending:

a feed command to the main feed line to carry the tray to the completing station; and a transfer command for transferring, to the transfer station, all the products of the tray from the main feed line towards the auxiliary, replenishing line;

wherein the management unit is configured to selectively send the feed command or the transfer command based on a result of the detecting carried out by the inspection station.

* * * * *